US007362041B2

(12) United States Patent
Lapatovich et al.

(10) Patent No.: US 7,362,041 B2
(45) Date of Patent: Apr. 22, 2008

(54) METHOD OF OPERATING AN ARC DISCHARGE LAMP AND A LAMP IN WHICH A SALT RESERVOIR SITE IS LOCALLY COOLED TO PROVIDE A CONDENSATION SITE FOR IODINE REMOTE FROM THE LAMP'S ELECTRODES

(75) Inventors: Walter P. Lapatovich, Boxford, MA (US); A. Bowman Budinger, Westford, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 432 days.

(21) Appl. No.: 11/023,398

(22) Filed: Dec. 29, 2004

(65) Prior Publication Data

US 2006/0138963 A1 Jun. 29, 2006

(51) Int. Cl.
*H01J 1/02* (2006.01)

(52) U.S. Cl. ..... 313/34; 313/634

(58) Field of Classification Search ..... 313/34, 313/634; 315/309

See application file for complete search history.

(56) References Cited

U.S. PATENT DOCUMENTS 4,959,588 A 9/1990 Vida et al.
6,580,200 B2 * 6/2003 Fukuyo et al. ..... 313/25

FOREIGN PATENT DOCUMENTS

EP 0 481 702 4/1992

* cited by examiner

*Primary Examiner*—Joseph Williams
*Assistant Examiner*—Bumsuk Won
(74) *Attorney, Agent, or Firm*—Young & Thompson

(57) ABSTRACT

A method of operating an arc discharge lamp and a lamp in which a light transmissive envelope encloses electrode tips, a salt and a fill that includes iodine, and in which after turning the lamp off, a first part of the light transmissive envelope is locally cooled relative to other parts of the light transmissive envelope to provide a condensation site for the iodine that is spaced from the electrode tips, the first part of the light transmissive envelope being where a salt reservoir forms and where the salt is cooled by the local cooling. The local cooling may be provided by an indentation in an outer sleeve around the light transmissive envelope, where the indentation contacts the first part to provide a heat sink.

17 Claims, 3 Drawing Sheets

METHOD OF OPERATING AN ARC DISCHARGE LAMP AND A LAMP IN WHICH A SALT RESERVOIR SITE IS LOCALLY COOLED TO PROVIDE A CONDENSATION SITE FOR IODINE REMOTE FROM THE LAMP'S ELECTRODES

BACKGROUND OF THE INVENTION

The present invention is directed to a method of operating an arc discharge lamp and to an arc discharge lamp in which lamp ignition is improved.

A problem with arc discharge lamps, particularly arc discharge lamps that are mercury-free, is that relatively low, reproducible and consistent breakdown voltages have been difficult to achieve. The breakdown voltage is the voltage at which lamp ignition begins, and erratic breakdown voltages can hinder or completely inhibit lamp ignition.

In such lamps, the interaction of the chemical fill with the arc tube components releases iodine in vapor form over time. The released iodine condenses when the lamp is turned off. During lamp cool-down, the iodine condenses randomly within the arc tube over a period of time that may exceed eight minutes, depending on the thermal inertia of the arc tube. The iodine is not static during this period and migrates within the arc tube to condense on surfaces that are only slightly cooler than ambient. The electrode tips and shanks (typically tungsten) are particularly good areas for iodine condensation because they are connected to cooler locations outside the lamp and are thermally conductive.

The growth of small dendritic crystals of iodine on the electrode tips is a particular problem for lamp ignition. During starting, the dendrites vaporize and reduce the E/N ratio locally (the EIN ratio is the local electric field strength per atomic density). The vaporizing dendrites loose their sharp surfaces to reduce E locally and increase atomic density to increase N locally. The net result of decreasing the E/N ratio is to quench the discharge and inhibit successful ignition.

The ignition properties of a lamp may be characterized by measuring its DC breakdown voltage. DC breakdown voltage represents the lowest voltage that can cause a sustained breakdown discharge to form.

FIG. 1 depicts a sequence of DC breakdown voltage measurements for a lamp not incorporating the present invention. Note that breakdown voltages were initially erratic and remained inconsistent even after 50 breakdown discharges. The initial breakdown voltages were on the order of 11-12 kv, and subsequent breakdown voltages decreased until a plateau was reached at about the $36^{th}$ breakdown, although some higher voltages occasionally occurred. Small dendrites of iodine initially were observed on the surfaces of the electrodes, particularly the electrode tips, and with each breakdown discharge some of the dendrites were vaporized. Eventually enough breakdown discharges took place so that little or no iodine was left on the surfaces of the electrodes and DC breakdown voltages returned to more normal values.

SUMMARY OF THE INVENTION

An object of the present invention is to provide a novel method of operating an arc discharge lamp and a novel arc discharge lamp in which part of the light transmissive envelope is locally cooled to provide a condensation site for the iodine other than the electrodes. More particularly, the locally cooled part is a part of the light transmissive envelope where a salt reservoir forms and where the salt in the reservoir provides a source of iodide-rich material on which the vaporized iodine may nucleate.

A further object of the present invention is to provide novel method of operating an arc discharge lamp and a novel arc discharge lamp in which a first part of the light transmissive envelope where the salt reservoir forms is locally cooled, and in which the lamp has an outer sleeve around the light transmissive envelope and the outer sleeve has an indentation in the outer sleeve that contacts the first part to locally cool the first part of the light transmissive envelope.

These and other objects and advantages of the invention will be apparent to those of skill in the art of the present invention after consideration of the following drawings and description of preferred embodiments.

DESCRIPTION OF PREFERRED EMBODIMENTS

Figure 2:
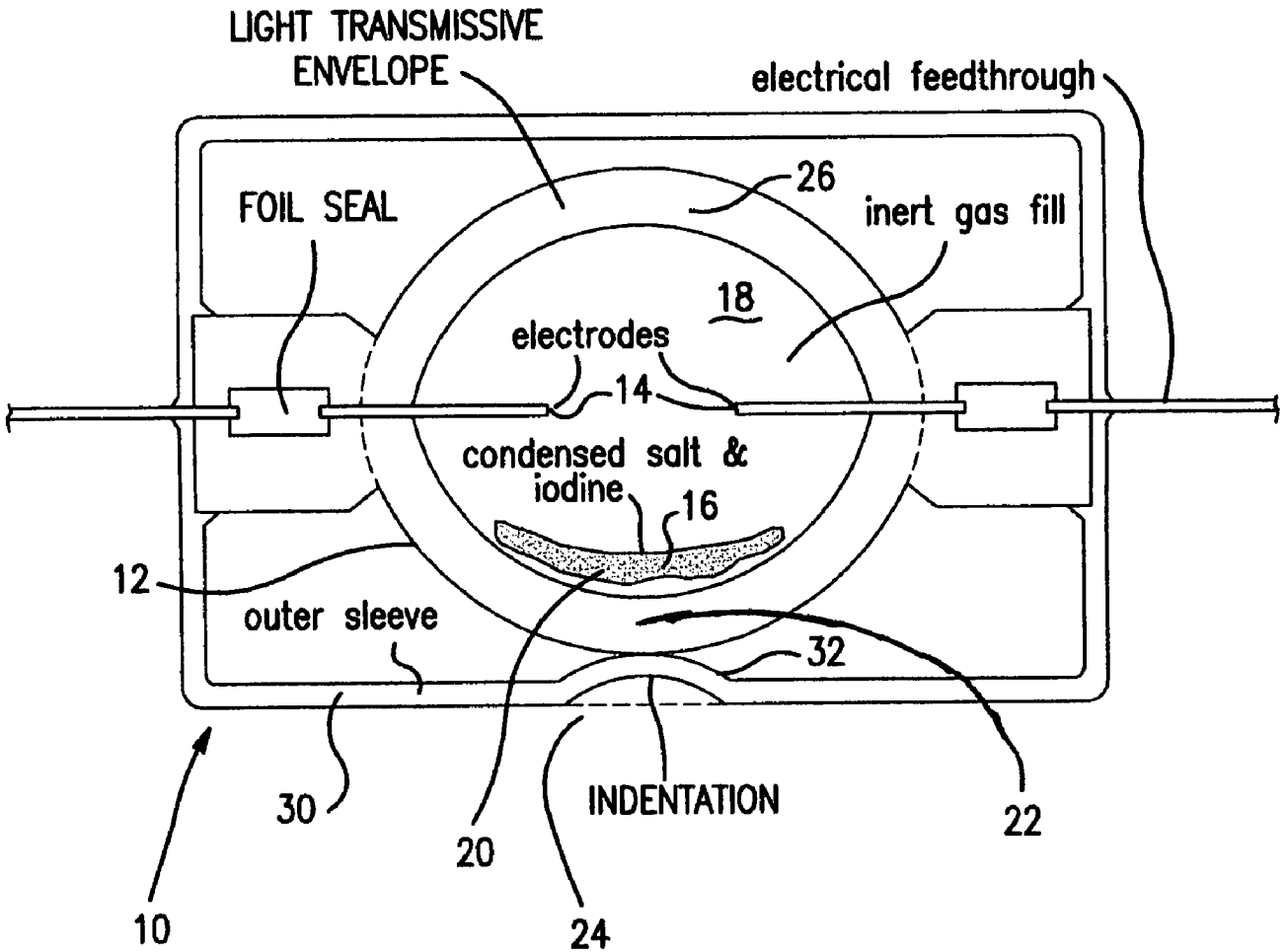
FIG. 2 is schematic diagram of an embodiment of the present invention.

With reference now to FIG. 2, an arc discharge lamp 10 includes a light transmissive envelope 12 that encloses electrode tips 14, a salt 16 and a fill 18 that includes iodine that is vaporized when the lamp is operating. The salt 16 forms a salt reservoir 20 at a first part 22 of the light transmissive envelope 12 at a bottom of the lamp after the lamp is turned off. The lamp 10 includes a local cooling device 24 for cooling the first part 22 of the light transmissive envelope 12 relative to other parts of the light transmissive envelope after the lamp is turned off to provide a condensation site for the iodine that is spaced from the electrode tips 14. In a preferred embodiment, the fill 18 is mercury-free.

The arc discharge lamp 10 is operated with the iodine vaporized, and the first part is locally cooled after turning the lamp off. The locally cooled first part 22 is a part of the light transmissive envelope 12 where the salt reservoir 20 forms and where the salt 16 provides a source of iodide-rich material on which the vaporized iodine may nucleate. Since the iodine condenses on the first part 22 of the light transmissive envelope and on the salt in the salt reservoir 20, the iodine dendrites do not form on the lamp electrodes, or form less frequently than in the prior art, so that lamp ignition is improved. All discharge lamps are started with a high voltage pulse. By reducing or eliminating the iodine condensation on the electrodes, less voltage is needed to start the lamp of the present invention than is needed for a typical discharge lamp. Since all standard power sources for typical discharge lamps provide a sufficient minimum voltage pulse to start a standard lamp, the lamp of the present invention, requiring a lower than standard starting voltage pulse, has an increased likelihood of starting with the same standard power sources. Note that when the lamp 10 is operating, the light transmissive envelope 12 has its hottest part at its top 26, which is generally diametrically opposite the first part 22 of the light transmissive envelope where the salt reservoir 20 forms.

That is, the present invention provides a cold spot for the iodine to condense when lamp power is removed. While the lamp 10 is energized, the coldest spot in the arc tube remains on the bottom of the light transmissive envelope 12 where the salt 16 resides. Upon turn-off, the salt condenses on the bottom in the salt reservoir 20, but the iodine remains in the vapor phase for several more minutes. During this time, the iodine will nucleate on relatively cold surfaces. Since the first part 22 and the salt reservoir 20 are locally cooled relative to the other parts of the light transmissive envelope, the iodine condenses here, away from the electrodes tips 14.

Figure 1:
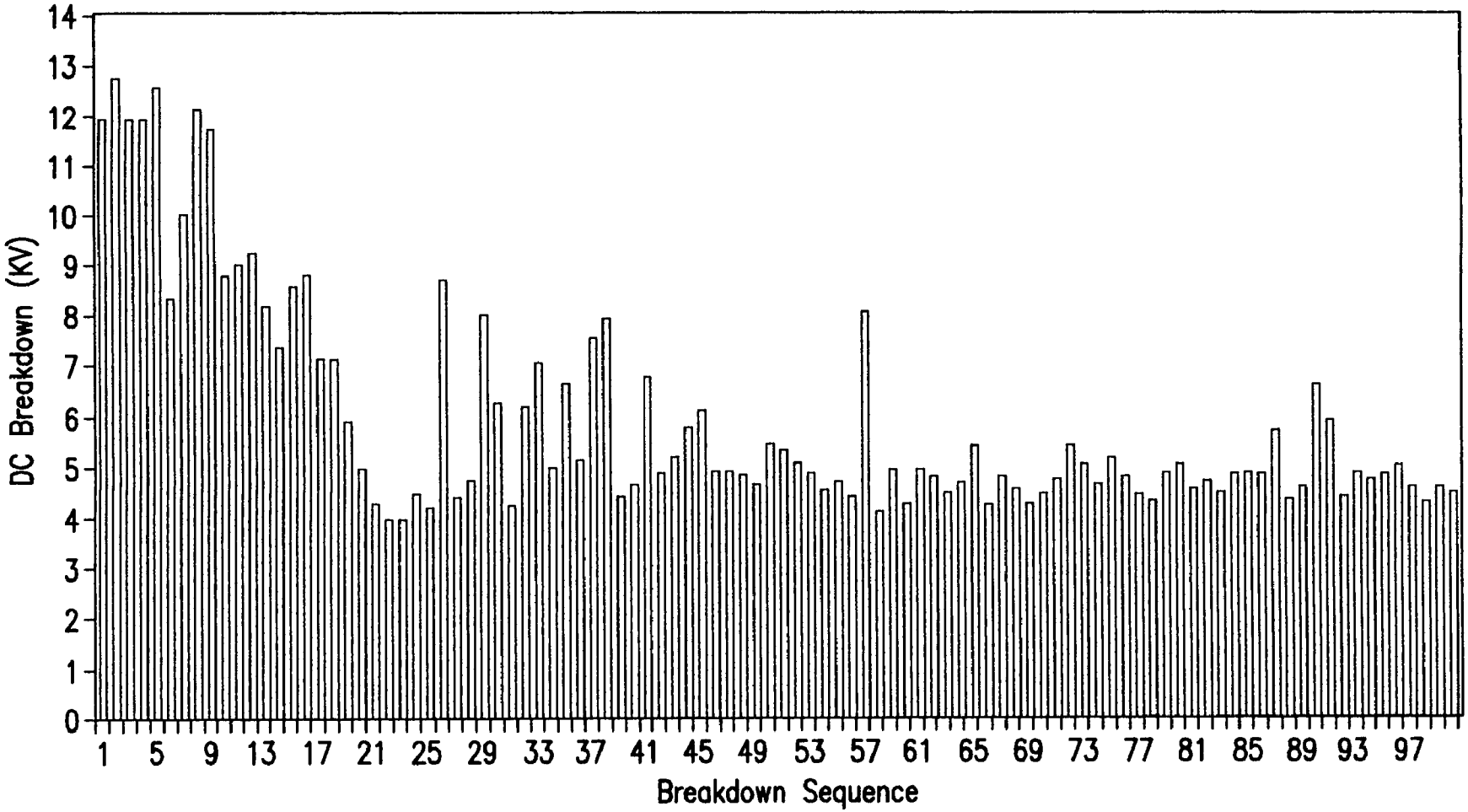
FIG. 1 is chart showing breakdown voltage as a function of breakdown sequence for a prior art lamp.
Figure 3:
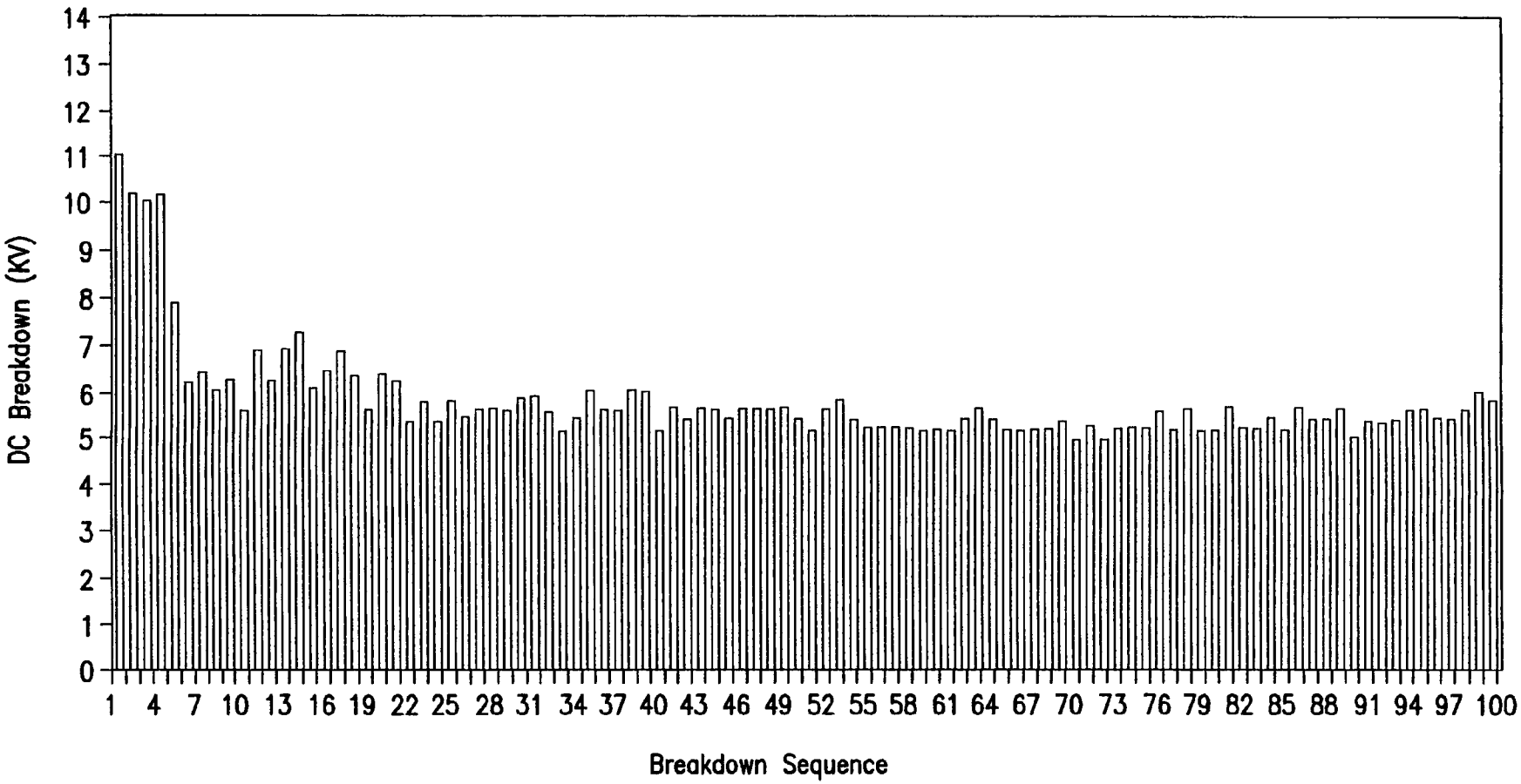
FIG. 3 is chart showing breakdown voltage as a function of breakdown sequence for the same type of lamp as FIG. 1 except that the light transmissive envelope is locally cooled in the manner illustrated in FIG. 2.

The results achieved by this improvement are shown in FIG. 3 that may be compared to FIG. 1. The results shown in FIG. 3 are for the same type of lamp as FIG. 1 under similar conditions, except that the first part of the light transmissive envelope is locally cooled as shown in FIG. 2. As is apparent from a comparison of FIGS. 1 and 3, the breakdown voltages achieved by the lamp and method herein were relatively low, reproducible and more consistent than in the lamp without the present invention.

In a preferred embodiment, the first part 22 is locally cooled relative to other parts of the light transmissive envelope 12 by providing the lamp 10 with an outer sleeve 30 that extends around the light transmissive envelope 12 in a manner known in the art. As noted above, the first part 22 is the part of the light transmissive envelope 12 where the salt reservoir 20 forms at a bottom of the lamp. The outer sleeve 30 is provided with an indentation 32 that contacts the first part 22 to conduct heat away from the first part 22, via the indentation 32, to the outer sleeve 30 that forms a heat sink. The indentation 32 may take any appropriate shape and may be a simple dimple or an elongate ridge that contacts the light transmissive envelope continuously or in several spaced apart places. Further, the indentation 32 need not be centered and may be offset to prevent optical occlusion of the bright arc core.

While embodiments of the present invention have been described in the foregoing specification and drawings, it is to be understood that the present invention is defined by the following claims when read in light of the specification and drawings.

We claim:

1. A method of operating an arc discharge lamp having a light transmissive envelope that encloses electrode tips, a salt and a fill that includes iodine, the method comprising the steps of:

operating the lamp with the iodine vaporized;

turning the lamp off; and after turning the lamp off, locally cooling a first part of the light transmissive envelope relative to other parts of the light transmissive envelope to provide a condensation site for the iodine that is spaced from the electrode tips, the first part of the light transmissive envelope being where a salt reservoir forms.

2. The method of claim 1, wherein the lamp has an outer sleeve around the light transmissive envelope, and wherein the locally cooling step comprises the step of conducting heat from the first part of the light transmissive envelope to an indentation in the outer sleeve that contacts the first part.

3. The method of claim 2, wherein the indentation is elongated and contacts the light transmissive envelope at one or more locations.

4. The method of claim 1, wherein the step of operating the lamp causes the light transmissive envelope to have a hottest part that is generally diametrically opposite the first part of the light transmissive envelope.

5. The method of claim 1, wherein during the cooling step the salt reservoir is cooled and the iodine condenses on the salt in the salt reservoir.

6. The method of claim 1, wherein the fill is mercury-free.

7. An arc discharge lamp comprising:

a light transmissive envelope that encloses electrode tips, a salt and a fill that includes iodine that is vaporized when the lamp is operating, the salt forming a salt reservoir at a first part of said light transmissive envelope after the lamp is turned off; and local cooling means for cooling said first part of said light transmissive envelope relative to other parts of said light transmissive envelope after the lamp is turned off to provide a condensation site for the iodine that is spaced from said electrode tips.

8. The lamp of claim 7, wherein said lamp has an outer sleeve around said light transmissive envelope, and wherein said local cooling means comprises an indentation in the outer sleeve that contacts said first part.

9. The lamp of claim 8, wherein said indentation is elongated and contacts said light transmissive envelope at one or more locations.

10. The lamp of claim 7, wherein said light transmissive envelope has a hottest part that is generally diametrically opposite said first part of said light transmissive envelope when the lamp is operating.

11. The lamp of claim 7, wherein said local cooling means cools the salt reservoir so that the iodine condenses on the salt in the salt reservoir.

12. The lamp of claim 7, wherein said first part of said light transmissive envelope is free of protuberances.

13. The lamp of claim 7, wherein said fill is mercury-free.

14. An arc discharge lamp comprising:

a light transmissive envelope that encloses electrode tips, a salt and a fill that includes iodine that is vaporized when the lamp is operating, the salt forming a salt reservoir at a first part of said light transmissive envelope after the lamp is turned off;

an outer sleeve around said light transmissive envelope; and said outer sleeve having an indented part that contacts said first part of said light transmissive envelope to cool said first part relative to other parts of said light transmissive envelope after the lamp is turned off to provide a condensation site for the iodine that is spaced from said electrode tips.

15. The lamp of claim 14, wherein said indentation is elongated and contacts said light transmissive envelope at one or more locations.

16. The lamp of claim 14, wherein said light transmissive envelope has a hottest part that is generally diametrically opposite said first part of said light transmissive envelope when the lamp is operating.

17. An arc discharge lamp comprising:

a light transmissive envelope that encloses electrode tips, a salt reservoir at a first part of said light transmissive envelope, and a fill that includes iodine;

an outer sleeve around said light transmissive envelope; and said outer sleeve having an indented part that contacts said first part of said light transmissive envelope to cool said first part relative to other parts of said light transmissive envelope to provide a condensation site for the iodine that is spaced from said electrode tips.

* * * * *